US005451932A

United States Patent [19]

Wunderlich et al.

[11] Patent Number: 5,451,932

[45] Date of Patent: Sep. 19, 1995

[54] METHOD AND MEANS FOR INDICATING AN APPLIANCE CONDITION

[75] Inventors: Daniel F. Wunderlich; Nedra A. Herr, both of Newton, Iowa

[73] Assignee: Maytag Corporation, Newton, Iowa

[21] Appl. No.: 22,958

[22] Filed: Feb. 25, 1993

[51] Int. Cl.[6] ..... G08B 21/00

[52] U.S. Cl. ..... 340/635; 340/640; 340/525; 340/588; 340/581; 219/109; 34/549

[58] Field of Search ..... 340/635, 640, 525, 581, 340/588, 589, 604; 34/549, 550; 68/20; 219/109

[56] References Cited

U.S. PATENT DOCUMENTS

| | | | |
|---|---|---|---|
| 3,762,064 | 10/1973 | Offutt | 34/550 |
| 4,142,782 | 3/1979 | O'Brian | 40/448 |
| 4,418,398 | 11/1983 | Hornung | 364/900 |
| 4,554,565 | 11/1985 | Kito et al. | 346/201 |
| 4,723,656 | 2/1988 | Kiernan et al. | 206/333 |
| 4,738,034 | 4/1988 | Maramatsu et al. | 40/448 |
| 4,763,493 | 8/1988 | Nishite et al. | 68/12 R |
| 4,893,484 | 1/1990 | Takahashi et al. | 68/12 R |
| 4,922,242 | 5/1990 | Parker | 340/476 |
| 4,955,213 | 9/1990 | Ohsugi et al. | 68/12 R |
| 5,128,616 | 7/1992 | Palmer | 324/435 |
| 5,202,677 | 4/1993 | Parker et al. | 340/786 |

*Primary Examiner*—Brent Swarthout
*Assistant Examiner*—Julie Lieu
*Attorney, Agent, or Firm*—Zarley, McKee, Thomte, Voorhees & Sease

[57] ABSTRACT

A display is provided for indicating changes between first and second operating conditions in an appliance such as a clothes dryer. A sensing circuit senses changes in operating conditions within the appliance. A heater is connected to the sensing circuit and is responsive to various signals produced by the sensing circuit to generate heat. An elongated thermally conductive substrate is mounted adjacent to the heater for receiving and conducting thermal energy produced by the heater. A layer of thermochromic material overlies the substrate and is capable of changing colors in response to changes in the temperature of the conductive substrate.

21 Claims, 3 Drawing Sheets

METHOD AND MEANS FOR INDICATING AN APPLIANCE CONDITION

BACKGROUND OF THE INVENTION

This invention relates to a method and means for indicating an appliance condition. While the present invention can be used for indicating a number of different types of conditions within an appliance, one particular application for the present invention is the indication of the degree of dampness of a fabric within a fabric dryer or clothes dryer.

Present clothes dryers do not include any means for visibly indicating the fabric dryness condition to the operator during the drying cycle.

SUMMARY OF THE INVENTION

Therefore, a primary object of the present invention is the provision of a method and means for indicating an appliance condition.

A further object of the present invention is the provision of a method and means for indicating the moisture level of fabric in a fabric dryer.

A further object of the present invention is the provision of an improved method and means for indicating an appliance condition which is reliable over a long period of time and which minimizes the need for repair or maintenance.

A further object of the present invention is the provision of a means for indicating an appliance condition which is economical to manufacture, durable in use, and efficient in operation.

The present invention achieves these objects with a visual display system utilizing a polymer film having a coating of temperature sensitive color changing ink thereon. The display system described in the present application is particularly adapted for indicating the moisture level of a fabric in a clothes dryer during the drying cycle. However, this display could be used in a variety of appliance display applications, including the indication of temperature levels, timer conditions, or numerous other conditions which might exist within an appliance.

The present invention includes a sensing circuit for sensing the changes in the operating conditions of the appliance. In the case of a clothes dryer, the sensing circuit is connected to the sensor bars which sense the moisture level of the fabric within the clothes dryer.

A heater is connected to the sensing circuit and is responsive to signals from the sensing circuit to generate heat. In the case of a clothes dryer, the heater is preferably a PTC thermistor which has the characteristic of remaining heated continuously even though it may be subjected to a plurality of intermittent on and off signals.

Adjacent the heater is a thermally conductive substrate for receiving and conducting thermal energy from the heater. A layer of thermochromic material overlies the substrate and is capable of changing colors in response to changes in the temperature of the conductive substrate.

In the preferred embodiment of the invention, the thermochromic material is adapted to change from an opaque condition below a threshold temperature to a transparent or translucent condition when it is heated above the threshold temperature. The preferred thermochromic material for the desired threshold temperature range is a thermochromic ink manufactured by Matsui International Co. Inc. under the product designation THC-801, Type 47, which has a threshold temperature between 44° and 58° C. If a lower threshold temperature range is desired it is possible to use a thermochromic ink manufactured by the same company under the product designation THC-803, Type 37, which has a threshold temperature between 33° and 42° C. It is understood that thermochromic materials are available for providing a wide range of threshold temperature.

In one form of the invention, an electrical resistor function as a second heater positioned in close proximity to the substrate. It is adapted to be heated when the PTC thermistor is actuated and for a predetermined period of time after the PTC thermistor is deactuated. This causes a portion of the thermochromic ink to remain in its transparent state for a predetermined time after the sensor bars within the clothes dryer sense that the clothes are dry. The reason for this modification is that slight dampness often still is present in the fabrics after the sensor bars indicate that the fabrics are dry. By continuing to activate the resistor for a predetermined period of time after the sensor bars indicate the clothes are dry, it is possible to insure that the last traces of dampness are removed before the indicator indicates the fabrics are dry.

The substrate and the thermochromic ink are preferably formed into an elongated strip. However, it is possible to create a plurality of segments of thermochromic ink which overlie the substrate. Each of these segments can be provided with a thermochromic ink having a threshold temperature different from the threshold temperatures of the other segments. With this segmented construction various segments can all be transformed into their transparent condition when the fabric is very moist, and can be progressively transformed into an opaque condition one at a time as the moisture level within the fabric decreases.

DETAILED DESCRIPTION OF THE PREFERRED EMBODIMENT

Figure 1:
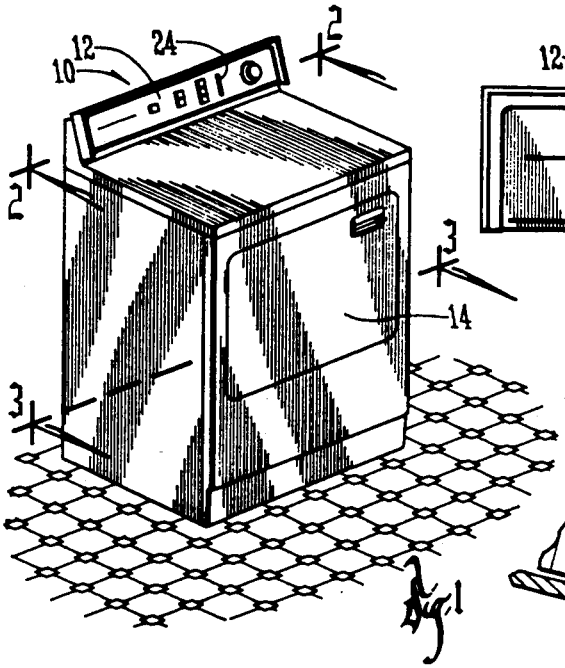
FIG. 1 is a perspective view of a clothes dryer utilizing the indicator of the present invention.
Figure 2:
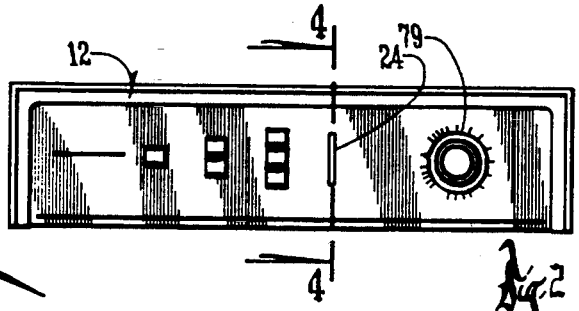
FIG. 2 is a front elevational detail view taken along Line 2—2 of FIG. 1.

Referring to the drawings the numeral 10 generally designates a typical clothes dryer. While the present invention is shown to be used for indicating the moisture level in fabrics in a clothes dryer, the present invention can also be used to indicate numerous other conditions which might occur in various appliances. For example it could be used as a coin drop indicator in a coin operated appliance for indicting to the user when the appropriate coins have been dropped into the appliance. It also could be used to indicate time of operation or the cycle in which the appliance is operating. Almost any condition within an appliance could be indicated with the present invention.

Figure 3:
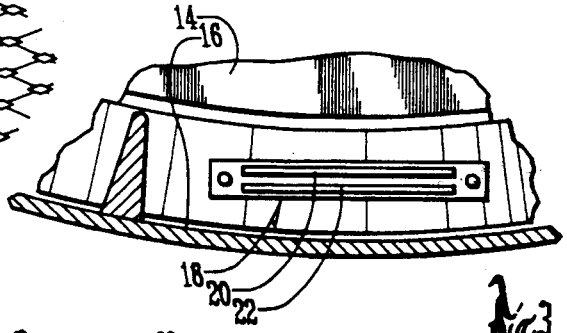
FIG. 3 is an enlarged sectional detail of the tumbler drum within the dryer, taken along Line 3—3 of FIG. 1.
Figure 4:
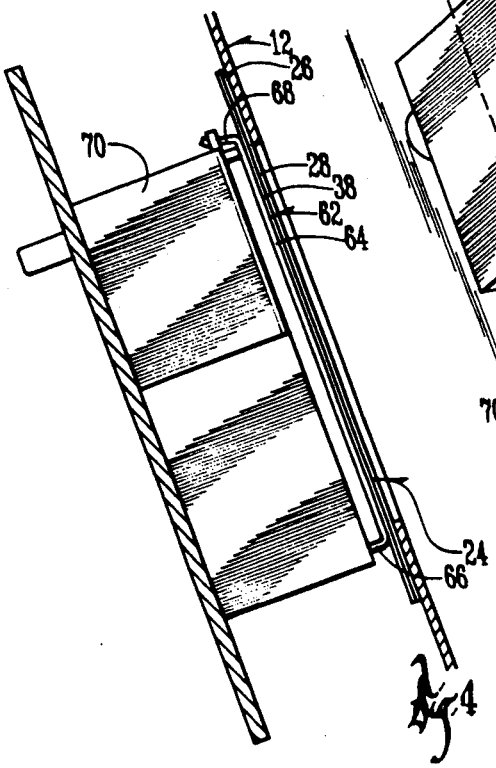
FIG. 4 is a sectional view taken along Line 4—4 of FIG. 2.
Figure 5:
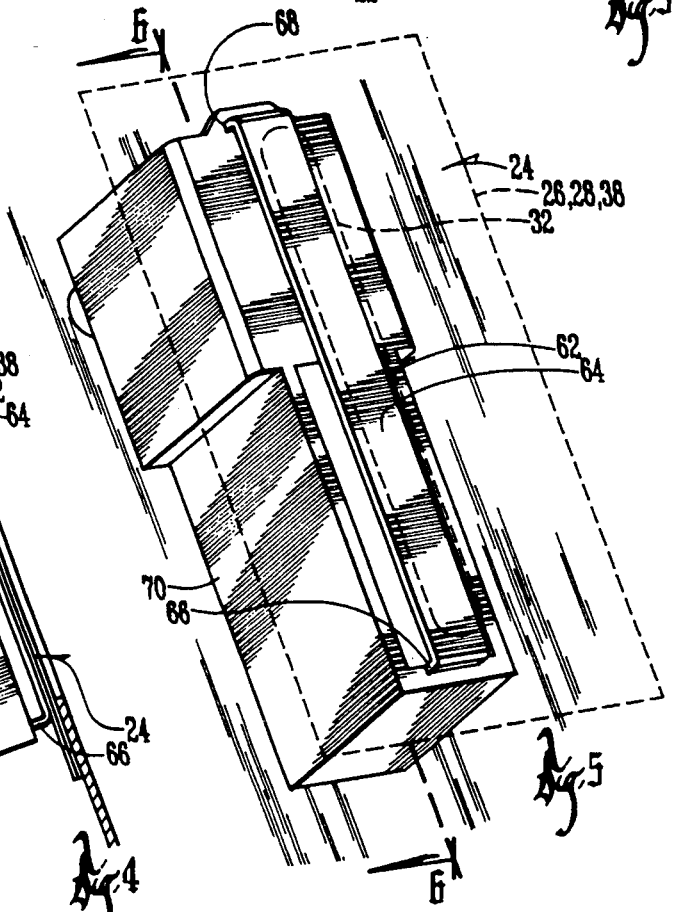
FIG. 5 is a perspective view of the moisture level indicator of the present invention.

Clothes dryer 10 includes a control panel 12, an access door 14, and a drying drum 16 (FIG. 3) located internally of the dryer 10. Within the drying drum 16 is a dampness or moisture sensor 18 comprising a pair of spaced apart sensor bars 20, 22. Sensor bars 20, 22 are electrical contacts which when bridged by damp fabric complete a circuit which actuates a moisture level indicator 24 located on the control panel 12.

Figure 6:
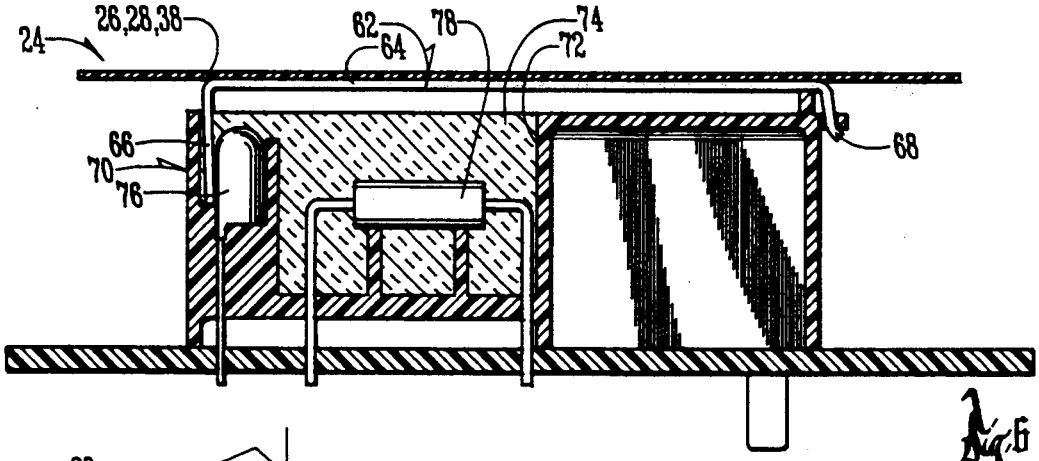
FIG. 6 is a sectional view taken along Line 6—6 of FIG. 5.
Figure 7:
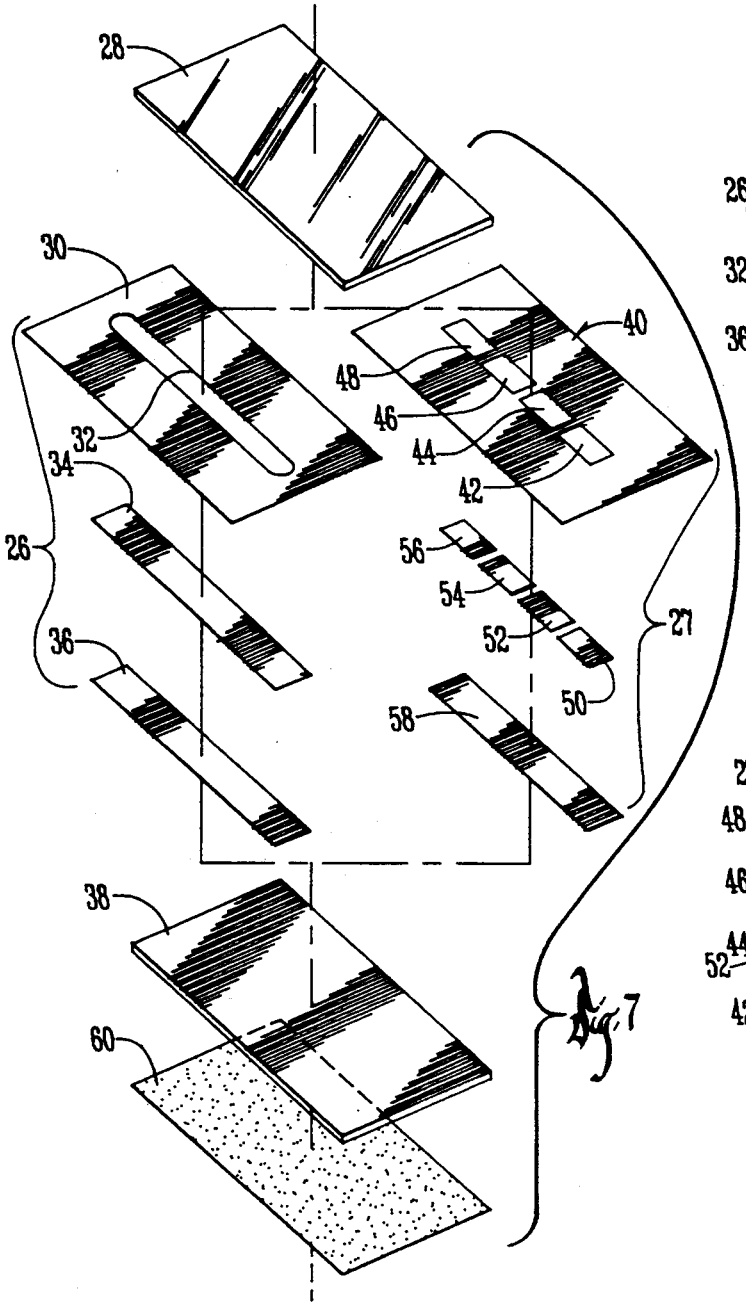
FIG. 7 is an exploded perspective view of the various laminates superimposed over the substrate, showing two alternative constructions.
Figure 8:
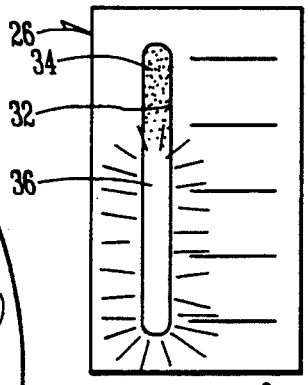
FIG. 8 is a plan view of the indicator utilizing the construction indicated on the lefthand portion of FIG. 7.

Moisture level indicator 24 is comprised of a laminated thermochromic member 26 illustrated in FIGS. 4–8. Referring to FIG. 7, the construction of thermochromic member 26 is shown in the lefthand portion of the figure and an alternative embodiment designated by the numeral 27 is shown in the righthand portion of FIG. 7. A transparent polyester sheet 28 is superimposed over the thermochromic member 26 (or the alternative thermochromic member 27).

Thermochromic member 26 is comprised of an upper layer of black paint 30 having an elongated window 32 therein. Below the paint layer 30 is a layer of thermochromic ink 34.

Thermochromic ink layer 34 is preferably a thermochromic ink manufactured by Matsui International Co. Inc. under the product designation THC-801, Type 47. This ink has a threshold temperature of between 44° and 58° C. Below the threshold temperature the ink is opaque, but above the threshold temperature the ink becomes transparent or translucent. Beneath the thermochromic ink 34 is a colored paint 36. For example the paint 36 may be colored a bright yellow or some other vivid color. When the thermochromic ink 34 is opaque, the colored paint 36 is hidden from view, but when the thermochromic ink 34 becomes transparent or translucent, the colored paint is visible through window 32 and through the thermochromic ink 34. Below the colored paint 36 is an opaque polyester layer 38.

The righthand portion of FIG. 7 shows the laminated construction for the alternative thermochromic member 27. Thermochromic member 27 includes a layer of black paint 40 having a plurality of windows 42, 44, 46, 48. A plurality of thermochromic ink segments 50, 52, 54, 56 are positioned in registered alignment below the windows 42, 44, 46, 48 respectively. Each of these thermochromic segments 50, 52, 54, 56 may be comprised of a thermochromic ink having a different threshold temperature. Numerous types of thermochromic ink having different threshold temperatures are available commercially. An example of a different type is manufactured by Matsui International Co. Inc. under the product designation THC-803, Type 37, which has a threshold temperature of between 33° and 42° C. Thus each of the segments 50, 52, 54, 56, may be constructed of different types of thermochromic ink adapted to be converted from opaque to transparent at different temperatures.

Beneath the segments 50, 52, 54, 56 is a colored paint 58 which is visible only when one or more of the segments 50, 52, 54, 56 is heated above its threshold temperature so as to become transparent.

The thermochromic members 26 or 27 are attached by means of an adhesive 60 to an elongated substrate 62. Substrate 62 is preferably constructed of metal or some other very good temperature conductor. The substrate 62 is comprised of a horizontal leg 64 having a first L-shaped leg 66 at one of its ends and having a second L-shaped leg 68 at the other of its ends. Substrate 62 is adapted to be mounted to a housing 70 having a cavity 72 therein.

As best shown in FIG. 6, cavity 72 is filled with a heat conductive resin 74. Resin 74 is preferably an epoxy resin manufactured by Emerson & Cuming Inc., Woburn, Mass. the trademark STYCAST, utilizing an epoxy resin designated by the product number 2850KT, together with a catalyst designated by the product number 24LV. This resin has the characteristic of high thermal conductivity with low thermal expansion.

Embedded within the resin 74 in cavity 72 are a PTC thermistor 76 and an electrical resistor 78 which function as first and second heaters respectively. The L-shaped end 66 of substrate 62 is also embedded within the resin 74 in close proximity to PTC thermistor 76 so as to be capable of conducting heat from thermistor 76 to the remainder of substrate 62. The other end 68 of substrate 62 is operatively attached to housing 70.

Figure 10:
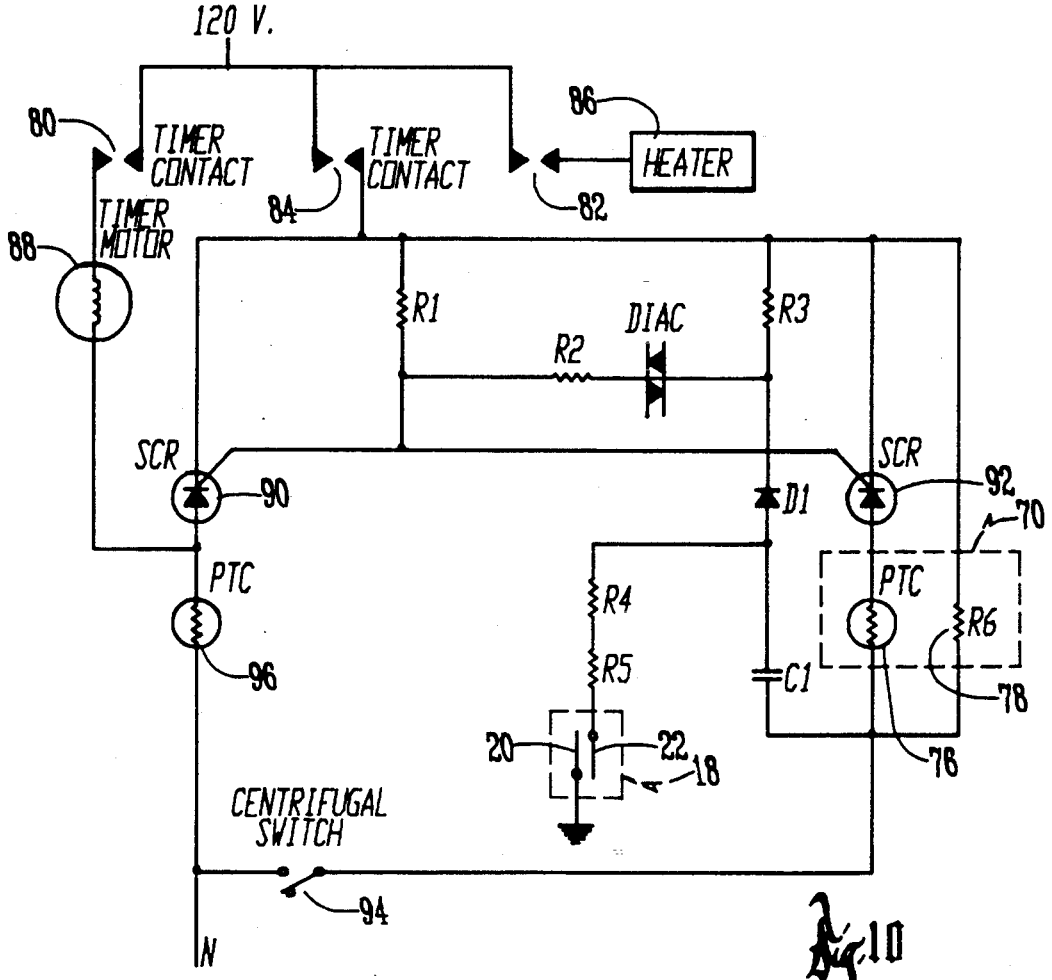
FIG. 10 is a schematic view of the electrical circuitry of the present invention.

In operation the clothes dryer 10 and moisture level indicator 24 are controlled by a control which is manually set by means of dial 79 on control panel 12. The dial 79 can be turned to place the clothes dryer 10 in either a timer mode or an automatic sensing mode. In the timer mode the drying operation is merely timed for a specified period of time determined by the setting of dial 79. In the automatic sensing mode, the present invention is utilized to sense and display or indicate the moisture content of the fabrics being dried and to cause the clothes dryer 10 to automatically shut off after the drying operation has been completed. The circuitry for operating in both the timer mode and the automatic sensing mode is shown in FIG. 10.

In the timer mode, both a timer motor contact 80 and a heater contact 82 are moved to their closed position. A third contact designated as electronic control timer contact 84 remains in its open position. The moisture level indicator 24 is not used in the timer mode of operation. The closing of contacts 80, 82, causes current to be introduced to a timer motor 88, and an appliance heater 86 respectively. The heater 86 comprises an electric resistance or gas heater for supplying fabric drying heat to the drying drum 16. The timer motor 88 continues to operate throughout the time mandated by the set position of dial 79. Throughout this time the drying drum 16 continues to rotate and the heater 86 continues to provide heat to the fabrics being dried. As the timer motor 88 completes its cycle, it causes the timer contacts 82 and 84 to move to their open position thereby causing the heater 86 and the dryer control to be deactuated. The motor rotating the drying drum 16 is also similarly later deactuated by circuitry not shown.

In order to operate the dryer 10 in the automatic sensing mode, the dial 79 is placed in the proper position to set the timer motor 88 for a particular period of time and also to close all three contacts 80, 82, and 84. A pair of SCRs 90, 92 are provided in the circuitry, and are normally in an open circuit condition which prevents the introduction of current to the PTC thermistor 76.

In the automatic sensing mode, during the initial operation of the clothes dryer 10 the moist fabrics engage the contact bars 20, 22 creating intermittent pulses of closed circuit conditions between the bars 20, 22. This causes intermittent pulses of current to be introduced to the 2 SCRs 90, 92, thereby causing the SCRs 90, 92 to be moved from their open circuit condition to their closed circuit condition. The SCR 90, causes a second PTC thermistor 96 to be self-energized to a high resistance state. The relatively high resistance state of thermistor 96 causes the voltage to timer motor 88 to be reduced to such a low level that motor 88 stops operating. SCR 92 permits current to be introduced to the PTC thermistor 76 and causes it to also be self-energized to a high resistance state. One advantage of using a PTC thermistor instead of a conventional resistor is that the pulses of energy coming to the PTC thermistor 76 are intermittent, resulting from the intermittent closing of the circuit between sensor bars 20, 22. The PTC thermistor 76, however retains its temperature continuously throughout the intermittent actuation. The temperature is retained because the resistance of PTC thermistor 76 varies in such a manner that the temperature of the device is held at a constant temperature.

As the PTC thermistor 76 heats up, its heat is transmitted to the first L-shaped leg 66 of elongated substrate 62. Because the substrate 62 is a good thermal conductor the heat from thermistor 76 travels from the L-shaped portion 66 along the horizontal portion 64 toward the second L-shaped end 68. As the substrate 62 heats up, its temperature is also conducted to the laminated thermochromic member 26 and causes the thermochromic ink 34 to be heated. As the thermochromic ink 34 reaches its threshold temperature, it progressively changes from an opaque condition to a transparent or translucent condition starting at the first L-shaped leg 66 thereby permitting the viewing of the colored paint 36 located below the thermochromic ink 34. Initially, when fabrics are sensed as being wet, the substrate will quickly be heated and the entire window 32 will be transparent so that paint 36 is visible. As the fabrics become dry and fewer hits are detected by the sensor bars 20, 22, the thermochromic ink 34 will cool allowing window 32 to gradually become opaque from top to bottom as viewed in FIG. 8.

Figure 9:
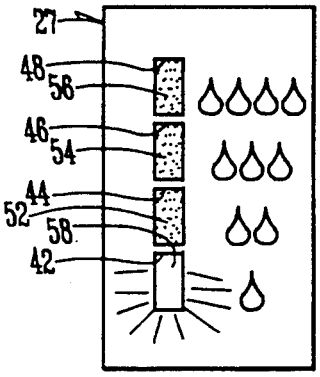
FIG. 9 is a top plan view of the indicator utilizing the laminated construction shown on the righthand portion of FIG. 7.

In the modified form of the invention utilizing the alternate embodiment 27, each of the separate thermochromic ink segments 50, 52, 54, 56 change from an opaque condition to a transparent condition at different temperatures. Thus the element 50 can be chosen so that its threshold temperature is the lowest and the segment 56 can be chosen so that its threshold temperature is the highest. This will cause the various segments 50, 52, 54, 56 to be sequentially transformed from an opaque condition to a transparent condition, one at a time. This produces a progressive indicator along the length of the substrate 62. FIG. 9 illustrates a condition wherein the first segment 50, is transparent so that the colored paint 58 can be viewed through segment 50 but not through segments 52–56. As each of the thermochromic segments 52, 54, 56, reach their respective threshold temperatures they progressively transform from an opaque condition to a transparent condition. As the fabrics become dry, the thermochromic ink segments 50, 52, 54, 56 will again become opaque starting at segment 56. The result is that the segments 50, 52, 54, 56 provide a variable indication of the amount of moisture in the fabrics within the clothes dryer 10.

The resistor 78 is actuated at the time that electronic control timer contact 84 is closed. The resistor 78 is not initially capable in and of itself to raise the temperature of the substrate 62 high enough to transform the thermochromic ink from its opaque to its transparent condition. However, after operating in combination with thermistor 76 during the drying cycle, the thermistor 76 and resistor 78 generate sufficient heat to cause at least the end of the thermochromic ink 34 adjacent the first L-shaped leg of substrate 62 (FIG. 8) to be transformed from its opaque to its transparent condition. If the embodiment shown in FIG. 9 is used, the thermochromic ink segment 50 is sufficiently heated by thermistor 76 and resistor 78 to be in a transparent condition.

The timer motor 88 remains deactuated during the entire time the moist fabrics short circuit sensor bars 20, 22. As the fabrics become nearly dry they stop short circuiting the sensor bars 20,22, thereby causing SCRs 90, 92 to return to their original open circuit condition. As a result the PTC thermistors 76, 96 are turned off.

However, the fabrics at this time are usually not completely dry and it is desirable to keep the dryer operating for an additional period of time. This is accomplished by the timer motor 88, which begins running again because it is no longer under the influence of thermistor 96. During the time that the timer motor 88 continues to run, the PTC thermistor 76 and 96 are off, but the resistor 78 continues to be actuated through electronic control timer contact 84. Resistor 78 provides sufficient heat to heat the end of thermochromic ink layer 34 adjacent the first L-shaped leg of substrate 62 (as viewed in FIG. 8) or the segment 50 (as viewed in FIG. 9) and maintain them in a transparent condition. As the timer motor 88 completes its cycle, it causes timer contacts 82 and 84 to be opened, thereby deactuating heater 86, and resistor 78. The thermochromic members 26, or 27 then cool and resume their opaque condition. The amount of time that resistor 78 remains actuated is controlled by the setting of dial 79.

The result of this configuration is that the entire window 32 is maintained in a transparent condition so long as the thermistor 76 is fully actuated. However, when the clothes become sufficiently dry to deactuate the PTC thermistor 76, the resistor 78 continues heating the substrate in a sufficient amount to maintain the end of window 32 adjacent the first L-shaped leg of substrate 62 (FIG. 8) in a transparent condition or the window 42 (FIG. 9) in a transparent condition. This indicates to the user that the clothes are nearly dry, and that the dryer will be operating for a short period of time before shutting off. As the timer 88 reaches the end of its cycle, the timer contacts 82 and 84 are opened and the resistor 78 is deactuated. The indicator then becomes entirely opaque and the operator knows that the clothes or fabrics are dry.

The present invention is highly reliable, having a minimum number of working parts. Furthermore the present invention eliminates the need for light emitting diodes which require extensive supporting circuitry. The device is very simple in operation and very simple in construction. The cost of manufacturing the device is low.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

We claim:

1. Apparatus for displaying changes between first and second operating conditions in an appliance comprising:

sensing circuit for sensing said changes in operating conditions of said appliance, said sensing circuit being adapted to create a first signal in response to sensing said first condition in said appliance and to create a second signal in response to sensing said second condition in said appliance;

a first heater connected to said sensing circuit and being actuatable in response to said first signal to generate heat, said first heater being deactuatable in response to receiving said second signal;

an elongated thermally conductive substrate mounted in heat transmitting relation to and adjacent said first heater for receiving and conducting thermal energy produced by said first heater;

a temperature sensitive material overlying said substrate and being capable of changing appearance in response to changes in the temperature of said conductive substrate;

a second heater adjacent and in heat transmitting relation to said conductive substrate; and a timer circuit connected to said first and second heaters for causing said second heater to be actuated to heat said conductive substrate for a predetermined time after deactuation of said first heater.

2. Apparatus according to claim 1 wherein said temperature sensitive material includes a thermochromic material.

3. Apparatus according to claim 2 wherein a layer of colored material is under said layer of thermochromic material, said thermochromic material being adapted to be opaque to prevent viewing of said colored material when cooled below a threshold temperature and being adapted to become transparent to permit viewing of said colored material when heated above said threshold temperature.

4. Apparatus according to claim 1 wherein said first heater is actuated in response to receipt of said first signal and is deactuated in response to receipt of said second signal.

5. Apparatus according to claim 1 wherein said sensing circuit comprises switch means capable of changing from a nonconductive state to a conductive state in response to said sensing circuit sensing said first condition in said appliance, said switch being capable of changing from said conductive state to said nonconductive state in response to said sensing circuit sensing said second condition in said appliance.

6. Apparatus according to claim 1 wherein said substrate includes first and second opposite ends, said first end being adjacent said first heater and said second end being farther away from said first heater than said first end.

7. Apparatus according to claim 1 wherein said first heater comprises a thermistor.

8. Apparatus according to claim 7 wherein said second heater is a resistor.

9. Apparatus according to claim 1 wherein said first heater is adapted to generate heat at a first temperature and said second heater is adapted to generate heat at a second temperature lower than said first temperature.

10. Apparatus for displaying the dryness level of fabrics being dried in a fabric dryer comprising:

a moisture sensing circuit for detecting the relative dryness condition of said fabrics being dried, said sensing circuit being adapted to create a dry signal in response to sensing a dry condition of said fabrics and an intermittent wet signal of varying frequency in response to sensing a moist condition of said fabrics;

a first heater connected to said sensing circuit and being actuated in response to said intermittent wet signal to generate heat continuously at a predetermined temperature, said first heater being deactuated in response to said dry signal;

a thermally conductive substrate mounted adjacent said first heater for receiving and conducting heat produced by said first heater;

a thermochromic member being of a first color and being positioned to receive heat from said substrate, said thermochromic member being capable of changing from said first color to a second color in response to being heated to a temperature above a threshold temperature, said thermochromic member being adapted to return to said first color when cooled to a temperature below said threshold temperature.

11. Apparatus according to claim 10 and further comprising switch means between said moisture sensing circuit and said first heater, said switch means being alternatively changeable between a conductive state and a non conductive state in response to said moisture sensing circuit sensing said moist condition and said dry condition respectively.

12. Apparatus according to claim 10 and further comprising a second heater adjacent said substrate, a timer circuit connected to said second heater for causing said second heater to be actuated for a predetermined time after deactuation of said first heater.

13. Apparatus according to claim 12 wherein said substrate includes first and second opposite ends, said first end being adjacent said first and second heaters and said second end being further away from said first and second heaters than said first end.

14. Apparatus according to claim 12 wherein said second heater comprises a resistor.

15. Apparatus according to claim 13 wherein said second heater is actuatable to heat said first end of said substrate to a temperature less than said predetermined temperature of said first heater and greater than said threshold temperature of said thermochromic member.

16. Apparatus according to claim 14 wherein said substrate and said thermochromic member are heated above said threshold temperature along their entire lengths in response to said first heater being actuated, said substrate and said thermochromic member being heated above said threshold temperature only along a portion of their lengths in response to said actuation of only said second heater.

17. Apparatus according to claim 10 wherein said first heater comprises a thermistor.

18. Apparatus for displaying changes between first and second operating conditions in an appliance comprising:

a sensing circuit for sensing said changes in operating conditions of said appliance, said sensing circuit being adapted to create a first signal in response to sensing said first condition in said appliance and to create a second signal in response to sensing said second condition in said appliance;

a thermistor connected to said sensing circuit and being responsive to said first signal to be actuated to generate heat, said thermistor being deactuated in response to said second signal;

an elongated thermally conductive substrate mounted adjacent said thermistor for receiving and conducting thermal energy produced by said thermistor;

a temperature sensitive material overlying said substrate and being capable of changing appearance in response to changes in the temperature of said thermally conductive substrate;

a resistor adjacent and in heat transmitting relation to said conductive substrate; and a timer circuit connected to said thermistor and said resistor for causing said resistor to be actuated to heat said conductive substrate for a predetermined period of time after deactuation of said thermistor.

19. Apparatus according to claim 18 and further comprising at least one appliance contact switch capable of actuating and deactuating said appliance, said timer circuit being connected to said appliance contact switch for maintaining said contact switch in a closed position to cause actuation of said appliance during said predetermined period of time after deactuation of said thermistor.

20. A method for sensing and displaying changes between first and second operating conditions in an appliance comprising:

using a sensing circuit to sense said changes between said first and second operating conditions of said appliance;

heating a temperature sensitive member above a threshold temperature in response to sensing said first operating condition of said appliance;

continuing to heat at least a portion of said temperature sensitive material above said threshold temperature for a predetermined time period after sensing said second operating condition;

cooling said temperature sensitive member below said threshold temperature in response to expiration of said predetermined time period, said temperature sensitive member having the characteristic of being a first color when heated above said threshold temperature and being a second color when cooled below said threshold temperature.

21. A method according to claim 20 wherein said sensing step comprises sensing a dry condition and a wet condition of fabrics being dried in a fabric dryer.

* * * * *